US007959150B2

(12) United States Patent
Krucinski et al.

(10) Patent No.: US 7,959,150 B2
(45) Date of Patent: Jun. 14, 2011

(54) EARLY CARRIAGE RESET MOVE FOR LATERALLY MOVABLE REGISTRATION DEVICE

(75) Inventors: Martin Krucinski, Webster, NY (US); Saurabh Prabhat, Webster, NY (US); Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 281 days.

(21) Appl. No.: 12/431,890

(22) Filed: Apr. 29, 2009

(65) Prior Publication Data

US 2010/0276872 A1 Nov. 4, 2010

(51) Int. Cl.
*B65H 7/02* (2006.01)

(52) U.S. Cl. ..... 271/228; 271/252; 271/273

(58) Field of Classification Search ..... 271/273, 271/274, 228, 252
See application file for complete search history.

(56) References Cited

U.S. PATENT DOCUMENTS

| | | | | |
|---|---|---|---|---|
| 5,994,711 | A | 11/1999 | Seachman et al. | |
| 6,032,004 | A | 2/2000 | Mirabella, Jr. et al. | |
| 6,373,042 | B1 | 4/2002 | Kretschmann et al. | |
| 6,533,268 | B2 | 3/2003 | Williams et al. | |
| 7,303,191 | B2 * | 12/2007 | Takagi et al. | 271/227 |
| 7,422,209 | B2 * | 9/2008 | Hashimoto | 271/228 |
| 7,422,211 | B2 * | 9/2008 | Dejong et al. | 271/249 |
| 7,686,299 | B2 * | 3/2010 | Herrmann | 271/249 |
| 7,722,039 | B2 * | 5/2010 | Shoji et al. | 271/273 |
| 7,766,326 | B2 * | 8/2010 | Obuchi et al. | 271/228 |
| 2008/0237974 | A1 | 10/2008 | Mandel et al. | |
| 2008/0296835 | A1 | 12/2008 | Dejong et al. | |
| 2009/0295076 | A1 * | 12/2009 | Kato et al. | 271/228 |

* cited by examiner

*Primary Examiner* — Jeremy Severson
(74) *Attorney, Agent, or Firm* — Gibb I.P. Law Firm, LLC

(57) ABSTRACT

A method and system feeds a sheet through a media path in a process direction. When the sheet is within a sheet registration carriage of the media path, the method and system align the sheet to a predetermined lateral position within the media path. The aligning process comprises unevenly activating nips within the sheet registration carriage and moving the sheet registration carriage in a lateral direction perpendicular to the process direction. If the lateral movement distance exceeds a predetermined distance, the method and system move the sheet registration carriage toward the starting position after the nips have released the sheet, but before the sheet has passed by the nips.

16 Claims, 4 Drawing Sheets

EARLY CARRIAGE RESET MOVE FOR LATERALLY MOVABLE REGISTRATION DEVICE

BACKGROUND AND SUMMARY

Embodiments herein generally relate to electrostatic printers and copiers or reproduction machines, and more particularly, concerns a system and method for aligning sheets within the media path and more particularly to embodiments that begin movement of a movable registration device before sheets have fully exited the movable registration device.

Certain sheet registration devices within media paths of printers and copiers require part of the registration device, in this case the carriage which performs the cross-process direction movement, to correct for sheet lateral error. The carriage also undergoes a reset move back to some home position after it registers a sheet. This movement back is normally done in the inter-document zone (IDZ) gap.

Depending on the pitch structure of the sheets/images on the photo-receptor, the sheet size, the incoming sheet registration errors, the input and output velocities and dimensional parameters, the accelerations and forces for the carriage reset move may become excessively large. Therefore, the registration device may not be able to complete the reset move within the time, velocity, and acceleration bounds provided. One approach is to always wait until sheets fully exit the carriage before beginning to return the carriage to the starting position.

The embodiments herein provide a system and a machine-implemented method that feeds at least one sheet through a media path in a process direction. The embodiments move the sheet registration carriage to its starting position before the sheet enters the sheet registration carriage. When the sheet is within the sheet registration carriage, the embodiments herein determine the amount of misalignment of the sheet using sensors positioned within the sheet registration carriage.

Further, when the sheet is within the sheet registration carriage, the embodiments herein align the sheet to a predetermined lateral position within the media path based on the amount of the misalignment. When performing the aligning process, the embodiments herein unevenly activate nips within the sheet registration carriage and simultaneously move the sheet registration carriage in a lateral direction perpendicular to the process direction.

In addition, when the sheet is still within the sheet registration carriage, the embodiments herein determine the lateral movement distance the sheet registration carriage will move when aligning the sheet. If the lateral movement distance of the sheet registration carriage exceeds a predetermined distance, the embodiments herein move the sheet registration carriage toward the starting position after the nips have released the sheet, but before the sheet has fully passed by the nips. To the contrary, if the lateral movement distance of the sheet registration carriage does not exceed the predetermined distance, the embodiments herein delay moving the sheet registration carriage toward the starting position until after the sheet has fully passed by the nips. The sheets are said to have fully passed by the nips when the trailing edge of the sheet is fully outside the nips.

This "predetermined distance" can comprise any appropriate distance depending upon the length of lateral travel that the sheet registration carriage is capable of moving, the speed at which the sheet registration carriage laterally moves, the speed at which the sheets are moving along the media path, etc. Thus, for example, the predetermined distance could be, one-third, one-quarter, one-fifth, one-eighth, etc. of the maximum lateral travel range of the sheet registration carriage.

Further, the predetermined distance can be an absolute measure (5 mm, 7 mm, 11 mm, etc.) or can be a fraction, a percentage, etc. of the maximum lateral travel range of the sheet registration carriage.

An apparatus embodiment herein comprises a controller and a media path operatively connected to the controller. The media path feeds sheets in a process direction. A laterally movable sheet registration carriage is positioned within the media path and is operatively connected to the controller. The sheet registration carriage is movable in a lateral direction perpendicular to the process direction.

Sensors are positioned within the sheet registration carriage. The sensors are operatively connected to the sheet registration carriage. Further, rollers are within the sheet registration carriage. Opposing ones of the rollers form nips that move the sheets through the sheet registration carriage. The nips are points where two rollers meet and are positioned at a different locations within the sheet registration carriage.

The sensors determine the amount of misalignment of the sheets within the sheet registration carriage. The sheet registration carriage aligns the sheets to a predetermined lateral position within the media path based on the amount of the misalignment by simultaneously unevenly activating the nips within the sheet registration carriage and moving the sheet registration carriage in the lateral direction.

When the sheet is within the sheet registration carriage, the controller determines the lateral movement distance the sheet registration carriage will move during the aligning of the sheet. If the lateral movement distance exceeds a predetermined distance, the controller moves the sheet registration carriage toward a starting position after the nips have released the sheet, but before the sheet has fully passed by the nips. To the contrary, if the lateral movement distance does not exceed the predetermined distance, the controller delays moving the sheet registration carriage toward the starting position until after the sheet has fully passed by the nips.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Many sheet registration devices need to reset some of their internal kinematic components to a proper starting position in preparation for receiving and registering the next sheet. During sheet registration these components move away from such a starting position.

An example of this is a registration device that includes a movable registration carriage. Such a device moves the whole carriage carrying the registration nips and sheet during registration in the cross-process direction. In order to have the same range of cross-process direction movement available for the next sheet, the carriage moves back to the nominal starting position before receiving the next sheet. This movement back is normally done in the inter-document zone gap.

Depending on the pitch structure of the sheets/images on the photo-receptor, the sheet size, the incoming sheet registration errors, the input and output velocities and dimensional parameters, the accelerations and forces for the carriage reset move may become excessively large. Therefore, the registration device may not be able to complete the reset move back to the starting position within the time, velocity, and acceleration bounds provided. One approach is to always wait until sheets fully exit the nips and the carriage is in the inter-document zone before beginning to return the carriage to the starting position.

Instead of only performing the registration device reset move within the inter-document zone, the embodiments herein sometimes start the reset move as soon as the registration nip is released. This provides some additional time for the reset move and lowers the required velocities, acceleration, and forces for the move. The embodiments herein use a threshold value to control whether there is a need to start resetting the carriage before the sheet has fully exited the carriage to avoid undesirable contact between the open nips and the trailing edge of the sheet that was just aligned.

Figure 1:
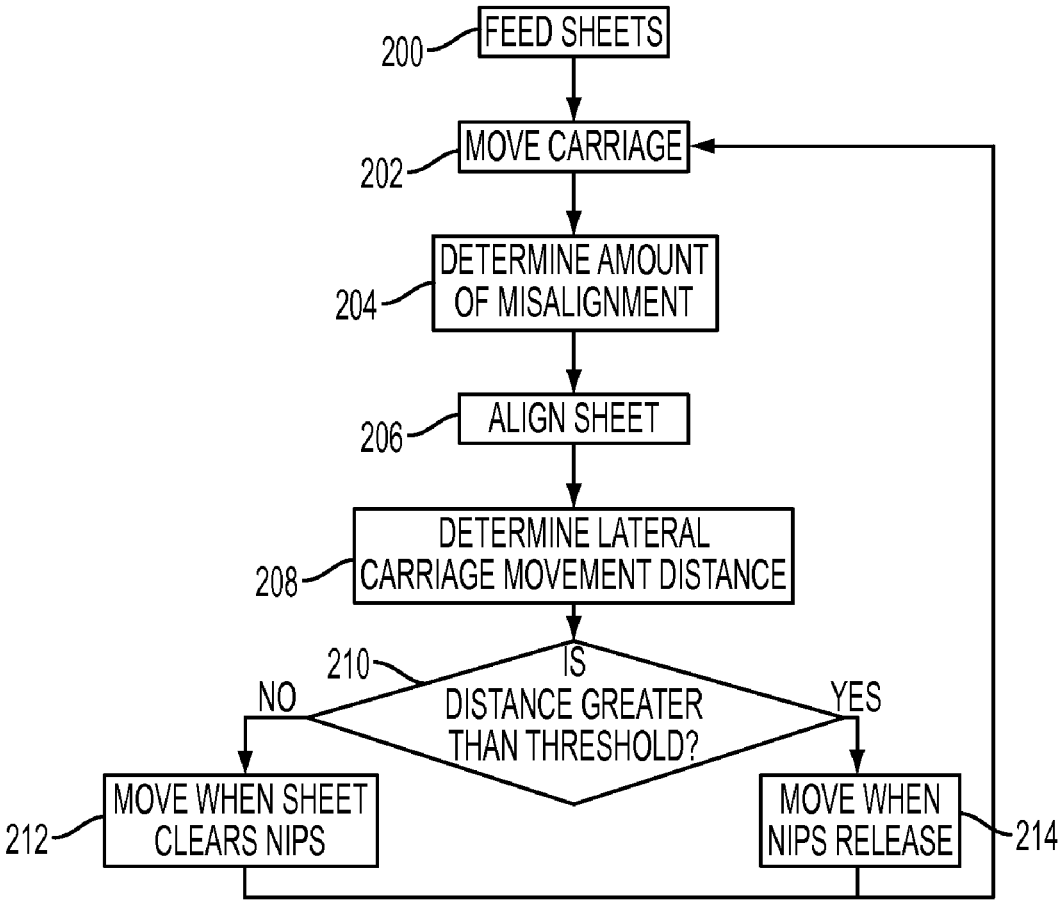
FIG. 1 is a flow diagram illustrating embodiments herein.

More specifically, as shown in flowchart form in FIG. 1, embodiments herein feed at least one sheet through a media path in a process direction in item 200. The embodiments move the sheet registration carriage to its starting position before the sheet enters the sheet registration carriage or drive element in item 202. When the sheet is within the sheet registration carriage, the embodiments herein determine the amount of misalignment of the sheet using sensors positioned within the sheet registration carriage (item 204).

Further, when the sheet is within the sheet registration carriage, in item 206, the embodiments herein align the sheet to a predetermined lateral position within the media path based on the amount of the misalignment. When performing the aligning process 206, the embodiments herein unevenly activate nips (drive the nips at different velocities) within the sheet registration carriage and simultaneously move the sheet registration carriage in a lateral direction perpendicular to the process direction.

In addition, when the sheet is still within the sheet registration carriage and is being aligned, in item 208, the embodiments herein determine the lateral movement distance the sheet registration carriage will move when aligning the sheet. If the lateral movement distance of the sheet registration carriage exceeds a predetermined distance (as determined by item 210) the embodiments herein move the sheet registration carriage toward the starting position after the nips have released the sheet but before the sheet has fully passed by the nips (item 214). To the contrary, if the lateral movement distance of the sheet registration carriage does not exceed the predetermined distance (as determined by item 210) the embodiments herein delay moving the sheet registration carriage toward the starting position until after the sheet has fully passed by the nips (item 212). Processing then returns to item 202 to complete the carriage moves back to the start position so that the next sheet can be processed. The sheets are said to have fully passed by the nips when the trailing edge of the sheet is fully outside the nips.

Figure 2:
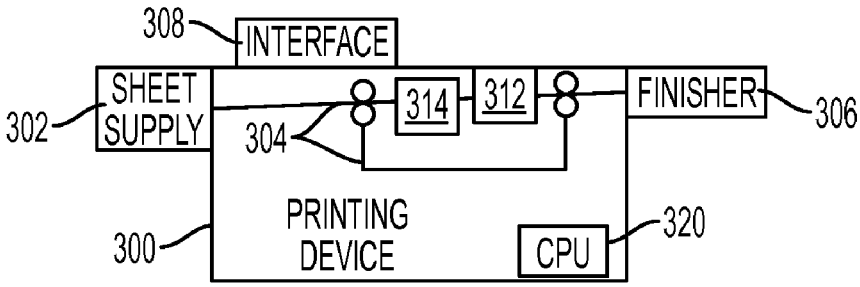
FIG. 2 is a schematic diagram of a printing apparatus according to embodiments herein.

FIG. 2 illustrates a printing apparatus 300 that includes a printing engine 312 (e.g., an electrostatic or xerographic printing engine) and a media path 304. The media path 304 transports sheets of print media to and from (relative to) the printing engine 312 (e.g., from a sheet supply 302, through a registration (alignment) unit 314, through the printing engine 312, and finally to a finisher 306). Alternatively, item 314 represents any movable drive element and is not specifically limited to a laterally movable registration unit. Such a movable drive unit 314 could move laterally, in an arc, or other movement direction. The media path 304 can include belts, rollers, or any other mechanism for moving media sheets. Item 308 illustrates the user interface and item 310 represents the processor (central processing unit (CPU)) or controller. The controller 310 is a computerized device and includes at least one computer storage media that stores instructions that the controller 310 executes to control the operations of the various components within the printer 300. The controller 310 can be connected to the sensors, drive rollers, registrations units, etc. and causes the actions described herein to occur.

Figure 3:
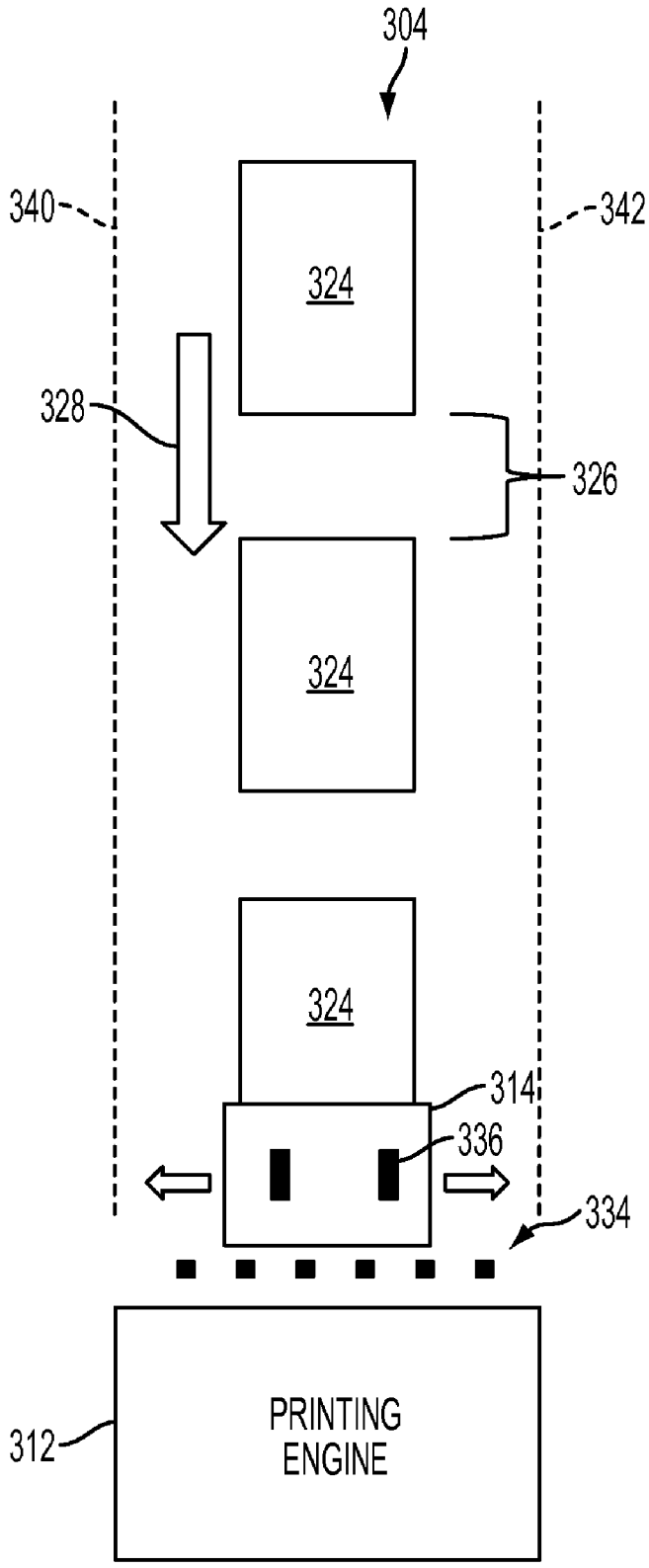
FIG. 3 is a schematic top-view diagram of a media path and alignment apparatus according to embodiments herein.

As shown in top-view in FIG. 3, system embodiments herein utilize the media path 304 to feed sheets 324 in a process direction (arrow 328) and a laterally movable sheet registration carriage/drive element 314 positioned within the media path 304. The inter-document zone gap is illustrated by 326. The sheets 324 can comprise any form of sheets, including paper, plastic, card stock, etc.

The sheet registration carriage 314 is movable in a lateral direction perpendicular to the process direction 328 from one extreme 340 (first side) of the media path 304 to another extreme 342 (second side) of the media path 304. Details regarding sheet registration are known. For example, see U.S. Pat. No. 7,422,211 and U.S. Patent Publication Numbers 2008/0296835, 2008/0237974, and the patents and publications mentioned therein (the complete disclosures of which are incorporated herein by reference).

Further, the system includes sensors 334 positioned within the sheet registration carriage 314. The sensors 334 are operatively connected to the sheet registration carriage 314. All the sensors discussed herein can comprise individual sensors, pairs of sensors, arrays of sensors, etc. The choice of what type of sensor to be used is primarily based on cost, power, and space considerations.

The sensors 334 determine the amount of misalignment of sheets 324 within the sheet registration carriage 314. The sheet registration carriage 314 aligns the sheets 324 using, for example, rollers 336 to a predetermined lateral position within the media path 304 based on the amount of the misalignment.

As mentioned above, the rollers 336 are within the sheet registration carriage. As shown in side-view in FIG. 4A, opposing rollers 336 form nips 344 that move the sheets 324 through the sheet registration carriage. The nips 344 are points where two rollers 336 meet.

The sensors 324 determine the amount of misalignment of the sheets 324 within the sheet registration carriage. The sheet registration carriage aligns the sheets 324 to a predetermined lateral position within the media path based on the amount of the misalignment by unevenly activating the nips 344 within the sheet registration carriage and simultaneously moving the sheet registration carriage in the lateral direction.

Figure 4A:
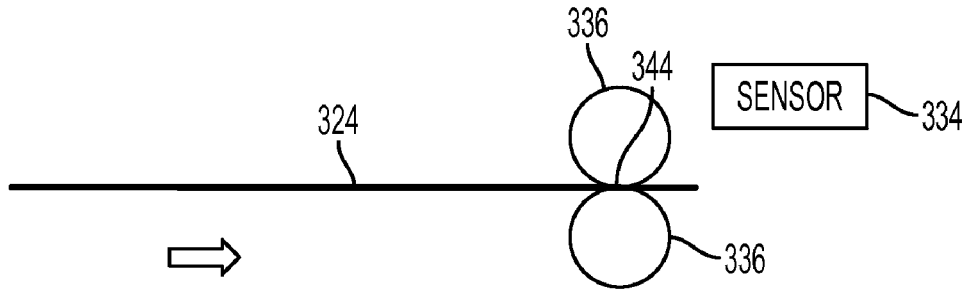
FIG. 4A-4C are schematic side-view diagrams of a media path and alignment apparatus according to embodiments herein.
Figure 4B:
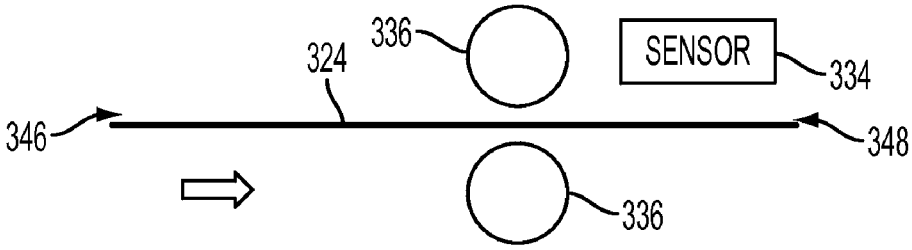
Figure 4C:
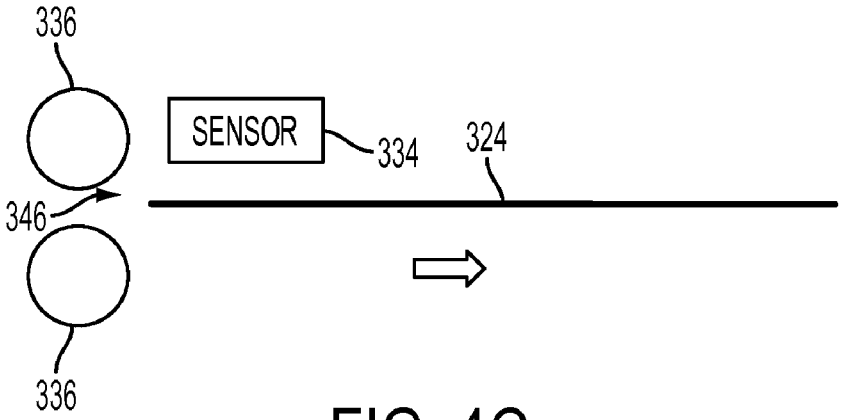

FIG. 4A illustrates the situation where the rollers 336 are actuated (closed and rolling) and are aligning the sheet 324 (as discussed in greater detail below) that is moving in the direction of the arrow shown in the drawings. FIG. 4B illustrates the situation where the rollers 336 have released the sheet 324 after having aligned the sheets to a specific lateral location within the media path 304 and having made the edges of the sheets parallel with the media path 304. However, in FIG. 4B the sheet 324 has not fully passed the rollers 336 (or the nips 344). More specifically, the leading edge 348 of the sheet 324 has passed the rollers 336 or nips 344; however, the trailing edge 346 of the sheet 324 has not yet passed the rollers 336 or nips 344. FIG. 4C illustrates the situation where the sheet 324 has fully passed the rollers 336 and nips 344 (where the trailing edge 346 of the sheet 324 has traveled past the rollers 336).

When the sheet 324 is within the sheet 324 registration carriage (within the nip 344; FIG. 4A) the controller determines the lateral movement distance the sheet registration carriage will move during the aligning of the sheet 324. If the lateral movement distance exceeds a predetermined distance, the controller moves the sheet registration carriage toward a starting position after the nips 344 have released the sheet 324, but before the sheet 324 has fully passed by the nips 344 (situation shown in FIG. 4B). To the contrary, if the lateral movement distance does not exceed the predetermined distance, the controller delays moving the sheet registration carriage toward the starting position until after the sheet 324 has fully passed by the nips 344 (situation shown in FIG. 4C).

This "predetermined distance" can comprise any appropriate distance depending upon the length of lateral travel that the sheet registration carriage is capable of moving, the speed at which the sheet registration carriage laterally moves, the speed at which the sheets 324 are moving along the media path, the size of the inter-document Zone gap 326, etc. Thus, for example, the predetermined distance could be, one-third, one-quarter, one-fifth, one-eighth, etc. of the maximum lateral travel range of the sheet registration carriage. Further, the predetermined distance can be an absolute measure (5 mm, 7 mm, 11 mm, etc.) or can be a fraction, a percentage, etc. of the maximum lateral travel range of the sheet registration carriage.

Therefore, the embodiments herein selectively alter when the sheet registration carriage begins to move back to the starting position. In situations where the sheet registration carriage does not have to move a great deal (relative to the size of the inter-document zone, the speed at which the sheet is traveling, the speed at which the sheet registration carriage can move, etc.) the embodiments herein will wait until the sheet has fully cleared the rollers to begin moving the carriage back to the starting position so as to eliminate the possibility that the rollers might contact the sheet. As mentioned above, if the rollers were to contact the sheet, this might degrade the quality of the printing on the sheet.

To the contrary, when the sheet registration carriage has to move a large distance (relative to the size of the inter-document zone, the speed at which the sheet is traveling, the speed at which the sheet registration carriage can move, etc.) The embodiments herein will take a chance of the rollers contacting the sheet and begin movement of the sheet registration carriage back to the starting position as soon as the rollers open the nips and release the sheet (situation shown in FIG. 4B). By beginning moving the sheet registration carriage earlier, the likelihood that the sheet registration carriage will reach the starting position before the next sheet rises dramatically and this allows more registration errors to the corrected. In addition, by selectively starting the sheet registration carriage movement early in limited situations, the chance of degrading print quality is not dramatically increased.

As mentioned above, movable carriage registration systems are known. For example, and U.S. Pat. No. 6,533,268 (the complete disclosure of which is incorporated herein by reference) discloses a movable carriage registration system similar to the one illustrated in FIG. 5 and U.S. Patent Publication Number 2008/0296835 discloses a movable carriage registration system similar to the one illustrated in FIG. 6.

Figure 5:
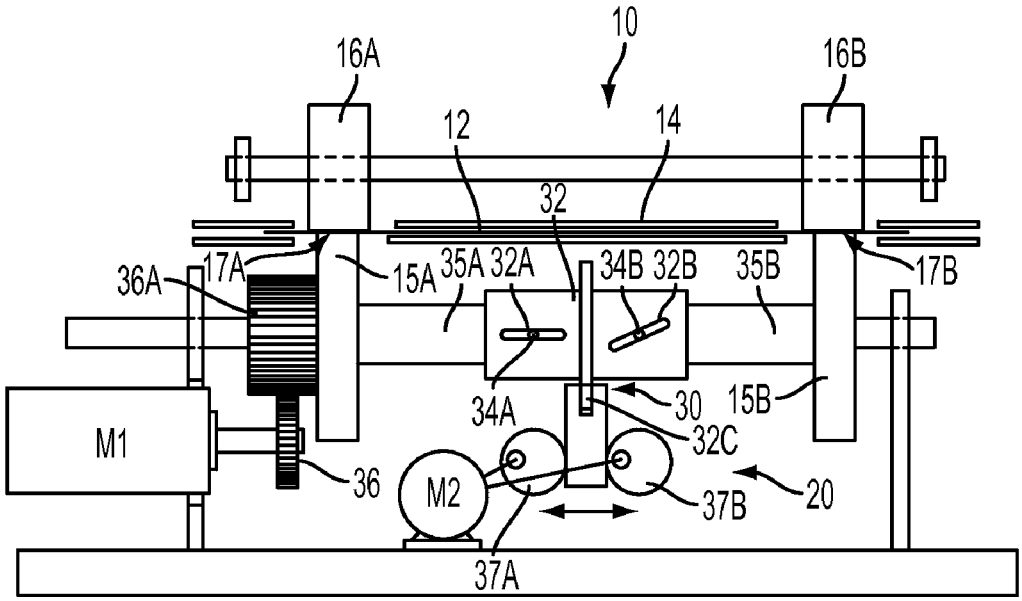
FIG. 5 is a schematic diagram of an alignment apparatus according to embodiments herein.

In FIG. 5, the sheet deskewing systems are for deskewing a sequence of sheets 12 and exemplary baffles 14 partially defining an exemplary printer 10 paper path are illustrated. Two laterally spaced sheet drive rollers 15A, 15B, the single servo-motor M1 sheet drive for both, and their mating idler rollers 16A, 16B forming the first and second drive nips 17A, 17B are shown in FIG. 5. Also, the small, low cost, low power, differential actuator drive motor M2 is shown.

These deskewing system embodiments drive the two drive nips 17A, 17B at the same rotational speed to feed the sheet 12 in those nips downstream in the paper path at the process speed, except when the need for deskewing that sheet 12 is detected by the optical sensors. That is, when the sheet 12 has arrived in the deskewing system in a skewed condition needing deskewing, a corresponding pitch change by a driving difference between the two drive roller 15A, 15B, rotary positions is made during the time the sheet 12 is passing through, and held in, the two sheet feeding nips 17A, 17B to accomplish deskew.

Any of these illustrated deskewing systems (or only key components thereof) may simply be mounted on simple lateral rails, rods, or carriages so as to be laterally driven by any of various such direct or indirect driving connections with another such servo-motor. These embodiments provide said paper deskewing by differential nip action through a simple and low cost differential mechanism system 30.

Here, in this deskewing system embodiment that differential system 30 comprises a pin-riding helically slotted sleeve connector 32 which is laterally transposed by the small low cost differential motor M2. This particular example is a tubular sleeve connector 32 having two slots 32A, 32B, at least one of which is angular, partially annular, or helical. These slots 32A, 32B respectively slideably contain the respective projecting pins 34A, 34B of the ends of the respective split co-axial drive shafts 35A, 35B over which the tubular sleeve connector 32 is slideably mounted. Each drive roller 15A, 15B is mounted to, for rotation with, a respective one of the drive shafts 35A, 35B, and one of those drive shafts, 34A here, is driven by the motor M1, here through the illustrated gear drive 36 although it could be directly. The two drive shafts 35A, 35B may themselves be tubular, to further reduce the system mass.

This variable pitch differential connection mechanism 30 enables a paper registration system that enables only one forward drive motor M1 to positively drive both nips 17A and 17B. Only the motor M1 needs to have the necessary power to propel the paper in the forward direction, while second much smaller, motor M2 does not need to drive the sheet forward, and only needs to provide enough power to operate the differential system 30 to correct for the sheet skew.

That differential system 30 is small, accurate, inexpensive, and requires little power to operate. It may be actuated by any of numerous possible simple mechanisms simply providing a short linear movement. For example, motor M2 rotates opposing cams 37A, 37B by the desired amount to move the tubular sleeve 32 (as by engagement with its projecting flange or arm 32C) laterally to change by the angle of the slot 32B the relative angular positions of the two pins 34A, 34B, and thereby correspondingly change the relative angular positions of their two shafts 35A, 35B, and thereby differentially rotate one drive roller 15B relative to the other drive roller 15A to provide the desired deskewing of the sheet 12 by the difference between the two nips. Yet both rollers 15A and 15B otherwise continue to be driven, to drive the sheet 12 in the process direction at the same speed, by the same motor M1, because the sleeve 32 is positive drive connecting shaft 35A to shaft 35B by the pins 34A and 34B engaged in the slots 32A and 32B of the shared sleeve 32.

Figure 6:
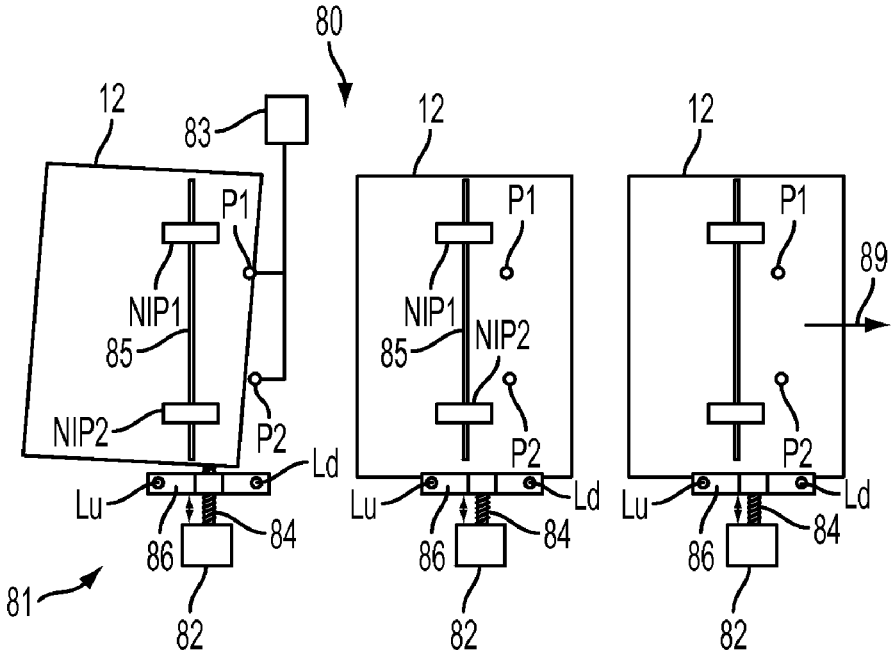
FIG. 6 is a schematic diagram of an alignment apparatus according to embodiments herein.

FIG. 6 shows a moving carriage lateral registration system 80 that enables active deskew of a sheet. Registration takes place in three primary phases as shown from left to right in FIG. 6. System 80 includes nips NIP 1 and NIP 2 that drive sheet 12 in the process direction of arrow 89. Sensors P1 and P2 detect the arrival of sheet 12 in the nips and start the lateral and skew registration.

The amount of skew is detected by the difference in time at which the leading edge of the sheet passes each of the sensors. That time difference represents a distance that directly relates to the amount of angular skew of the sheet. The outputs of sensors P1 and P2 are supplied to controller 83 that evaluates the amount of skew and provides an appropriate control signal to a conventional stepping motor (not shown) that in turn provides appropriate directional information such that the angular position of NIP 1 to NIP 2 about axis of rotation 85 is precisely changed to change the angular position of the sheet. The angular adjustment of NIP 1 with respect to NIP 2 takes place while the nips continue to drive the sheet, at high speed, towards a handoff point. A conventional differential drive mechanism useful in practicing this disclosure is shown in U.S. Pat. No. 5,278,624 and is incorporated herein by reference.

Simultaneously, a pair of sensors Lu and Ld mounted on a bar 86 that is connected to a rotatable screw 84 are moved (either inboard or outboard depending on the sheet position, as indicated by the double headed arrow) to "find" the top edge of the sheet. Sensors Lu and Ld send signals to controller 83 that, in turn, actuates motor 82 which through screw mechanism 84 moves bar 86 and the sensors to find the top edge of the sheet. Translating carriage 81 is controlled to follow the sheet to maintain the sensor position relative to the top edge of the sheet while the sheet is actively deskewed Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. An apparatus comprising:

a controller;

a media path operatively connected to said controller, said media path feeding sheets in a process direction;

a laterally movable sheet registration carriage positioned within said media path and being operatively connected to said controller, said sheet registration carriage being movable in a lateral direction perpendicular to said process direction;

said sheet registration carriage aligning said sheets to a predetermined lateral position within said media path by simultaneously unevenly activating nips within said sheet registration carriage and moving said sheet registration carriage in said lateral direction, when said sheet is within said sheet registration carriage, said controller determines a lateral movement distance said sheet registration carriage will move in said lateral direction during said aligning of said sheet;

if said lateral movement distance exceeds a predetermined distance, said controller moves said sheet registration carriage toward a starting position after said nips have released said sheet, but before said sheet has passed by said nips; and if said lateral movement distance does not exceed said predetermined distance, said controller delays moving said sheet registration carriage toward said starting position until after said sheet has passed by said nips.

2. The apparatus according to claim 1, said predetermined distance comprising one-quarter of a maximum lateral travel range of said sheet registration carriage.

3. The apparatus according to claim 1, said sheet having passed by said nips when a trailing edge of said sheet is fully outside said nips.

4. The apparatus according to claim 1, further comprising altering said predetermined distance based on at least one of: a length of an inter-document zone gap between said sheets, a speed of travel of said sheets, and a size of said sheets.

5. An apparatus comprising:

a controller;

a media path operatively connected to said controller, said media path feeding sheets in a process direction;

a laterally movable sheet registration carriage positioned within said media path and being operatively connected to said controller, said sheet registration carriage being movable in a lateral direction perpendicular to said process direction;

sensors positioned within said sheet registration carriage, said sensors being operatively connected to said sheet registration carriage; and rollers within said sheet registration carriage, said rollers forming nips that move said sheets through said sheet registration carriage, said sensors determining an amount of misalignment of sheets within said sheet registration carriage, said sheet registration carriage aligning said sheets to a predetermined lateral position within said media path based on said amount of said misalignment by simultaneously unevenly activating said nips within said sheet registration carriage and moving said sheet registration carriage in said lateral direction, when said sheet is within said sheet registration carriage, said controller determines a lateral movement distance said sheet registration carriage will move in said lateral direction during said aligning of said sheet;

if said lateral movement distance exceeds a predetermined distance, said controller moves said sheet registration carriage toward a starting position after said nips have released said sheet, but before said sheet has fully passed by said nips; and if said lateral movement distance does not exceed said predetermined distance, said controller delays moving said sheet registration carriage toward said starting position until after said sheet has fully passed by said nips.

6. The apparatus according to claim 5, said predetermined distance comprising one-quarter of a maximum lateral travel range of said sheet registration carriage.

7. The apparatus according to claim 5, said sheet having fully passed by said nips when a trailing edge of said sheet is fully outside said nips.

8. The apparatus according to claim 5, further comprising altering said predetermined distance based on at least one of: a length of an inter-document zone gap between said sheets, a speed of travel of said sheets, and a size of said sheets.

9. A machine-implemented method comprising:

feeding a sheet through a media path in a process direction;

when said sheet is within a sheet registration carriage of said media path, aligning said sheet to a predetermined lateral position within said media path, said aligning comprising unevenly activating nips within said sheet registration carriage and moving said sheet registration carriage in a lateral direction perpendicular to said process direction;

when said sheet is within said sheet registration carriage, using a controller to determine a lateral movement distance said sheet registration carriage will move in said lateral direction during said aligning of said sheet;

if said lateral movement distance exceeds a predetermined distance, using said controller to move said sheet registration carriage toward said starting position after said nips have released said sheet, but before said sheet has passed by said nips; and if said lateral movement distance does not exceed said predetermined distance, using said controller to delay moving said sheet registration carriage toward said starting position until after said sheet has passed by said nips.

10. The method according to claim 9, said predetermined distance comprising one-quarter of a maximum lateral travel range of said sheet registration carriage.

11. The method according to claim 9, said sheet having passed by said nips when a trailing edge of said sheet is fully outside said nips.

12. The method according to claim 9, further comprising altering said predetermined distance based on at least one of: a length of an inter-document zone gap between said sheets, a speed of travel of said sheets, and a size of said sheets.

13. A machine-implemented method comprising:

feeding a sheet through a media path in a process direction;

moving a sheet registration carriage to a starting position before said sheet enters said sheet registration carriage;

when said sheet is within said sheet registration carriage, using a controller to determine an amount of misalignment of said sheet using sensors positioned within said sheet registration carriage;

when said sheet is within said sheet registration carriage, aligning said sheet to a predetermined lateral position within said media path based on said amount of said misalignment, said aligning comprising simultaneously unevenly activating nips within said sheet registration carriage and moving said sheet registration carriage in a lateral direction perpendicular to said process direction;

when said sheet is within said sheet registration carriage, using a controller to determine a lateral movement distance said sheet registration carriage will move in said lateral direction during said aligning of said sheet;

if said lateral movement distance exceeds a predetermined distance, using said controller to move said sheet registration carriage toward said starting position after said nips have released said sheet, but before said sheet has fully passed by said nips; and if said lateral movement distance does not exceed said predetermined distance, using said controller to delay moving said sheet registration carriage toward said starting position until after said sheet has fully passed by said nips.

14. The method according to claim 13, said predetermined distance comprising one-quarter of a maximum lateral travel range of said sheet registration carriage.

15. The method according to claim 13, said sheet having fully passed by said nips when a trailing edge of said sheet is fully outside said nips.

16. The method according to claim 13, further comprising altering said predetermined distance based on at least one of: a length of an inter-document zone gap between said sheets, a speed of travel of said sheets, and a size of said sheets.

* * * * *